US005558181A

United States Patent [19]

Bundo

[11] Patent Number: 5,558,181

[45] Date of Patent: Sep. 24, 1996

[54] ELEVATOR

[76] Inventor: Mutsuro Bundo, 6-11, Funai-cho 1-chome, Oita-shi, Oita-ken, Japan

[21] Appl. No.: 368,632

[22] Filed: Jan. 4, 1995

[51] Int. Cl.[6] ..... B66B 9/02

[52] U.S. Cl. ..... 187/270

[58] Field of Search ..... 187/270, 255

[56] References Cited

U.S. PATENT DOCUMENTS

| | | | |
|---|---|---|---|
| 561,223 | 6/1896 | Hamilton | 187/270 |
| 1,634,854 | 7/1927 | Scolland | 187/270 |

FOREIGN PATENT DOCUMENTS

| | | | |
|---|---|---|---|
| 690819 | 9/1930 | France | 187/270 |

*Primary Examiner*—Kenneth Noland
*Attorney, Agent, or Firm*—Wenderoth, Lind & Ponack

[57] ABSTRACT

An elevator including a cage disposed in a vertical passage and having a door has a plurality of pinions carried on a pair of substantially horizontal rotary shafts supported along a pair of edges, respectively, of at least the top or bottom of the cage. The shafts extend in parallel to a pair of opposite sidewalls of the passage which lie at right angles to the door. A plurality of vertical racks are secured to the sidewalls of the passage, each engageable with at least one of the pinions. An irreversible driving device is associated with the pinions for rotating them to raise and lower the cage along the racks.

3 Claims, 2 Drawing Sheets

ELEVATOR

BACKGROUND OF THE INVENTION

1. Field of the Invention

This invention relates to an elevator, and more particularly, to a driving device for raising and lowering the cage of the elevator.

2. Description of the Prior Art

In a known elevator, a pulley for driving hoisting cables and a device for driving the pulley are usually installed above the top of an elevator shaft, or passage, as on the roof of a building. The cage of the elevator is suspended from the cables at one end thereof, and a counterweight from the other end thereof. The pulley is driven to raise and lower the cage.

The elevator also provided with a safety device. The safety device usually comprises a pair of vertical rails secured to a pair of opposite sidewalls of the elevator shaft, and a lever type roller bogie disposed between each rail and the cage and connected to the cage. Should any hoisting cable have been broken, the weight of the cage bears upon the lever of the roller bogie and the elevator stops automatically. The rails also serve to guide the cage for swing-free movement.

The known elevator has, however, a number of drawbacks. A large space is required for the installation of the pulley and other devices, e.g. on the roof of the building, and hoisting cables, which are large in length. All of these devices need a large space and are expensive. The safety device is also expensive. The maintenance of any of those devices is also a costly job. The cables, which are repeatedly bent and stretched about the pulley, have a short life due to broken wires.

SUMMARY OF THE INVENTION

Under these circumstances, it is an object of this invention to provide an elevator which is operable by an irreversible driving device mounted on its cage without the aid of any hoisting cable.

This object attained by an elevator which comprises a cage, a plurality of pinions carried on a pair of substantially horizontal rotary shafts supported along a pair of edges, respectively, of at least the top or bottom of the cage, and extending in parallel to a pair of opposite sidewalls of an elevator passage, a plurality of vertical racks secured to the sidewalls of the passage each engageably with at least one of the pinions, and an irreversible driving device engaging the pinions for driving them to raise and lower the cage along the racks.

"Irreversible" used herein means a state wherein a driving force can be transmitted from a driving side to a driven side, but any reaction force can not be transmitted from the driven side to the driving side.

The elevator of this invention does not call for any hoisting cable, but is operated by the pinions and racks. Therefore, it is free from any problem of a broken cable, and is reliable in operation. It does not call for any pulley or other device as is usually installed on the roof of the building. Even if any of the pinions or racks may have a broken tooth, there is no fear at all of the elevator falling down, and having any other critical problem in operation. Therefore, the elevator of this invention does not call for any special safety device, though the invention does not preclude the provision of a safety device.

The driving device is irreversible in operation, as will later be described in further detail. If just the driving device is appropriately controlled, it is possible to move or stop the elevator accurately. No braking device is required. There is no fear of any undesirable movement of the elevator being caused by a variation in weight of the elevator including its passengers as a result of an increase in number of the passengers, or due to any other reason.

The elevator of this invention is, thus, compact in construction and requires only a small space for installation, as compared with the known elevator. Therefore, it is less expensive to install and maintain, and yet is safer in operation.

BRIEF DESCRIPTION OF THE DRAWINGS

Other features and advantages of this invention will become apparent from the following description and the accompanying drawings, in which.

DETAILED DESCRIPTION OF THE INVENTION

Figure 1:
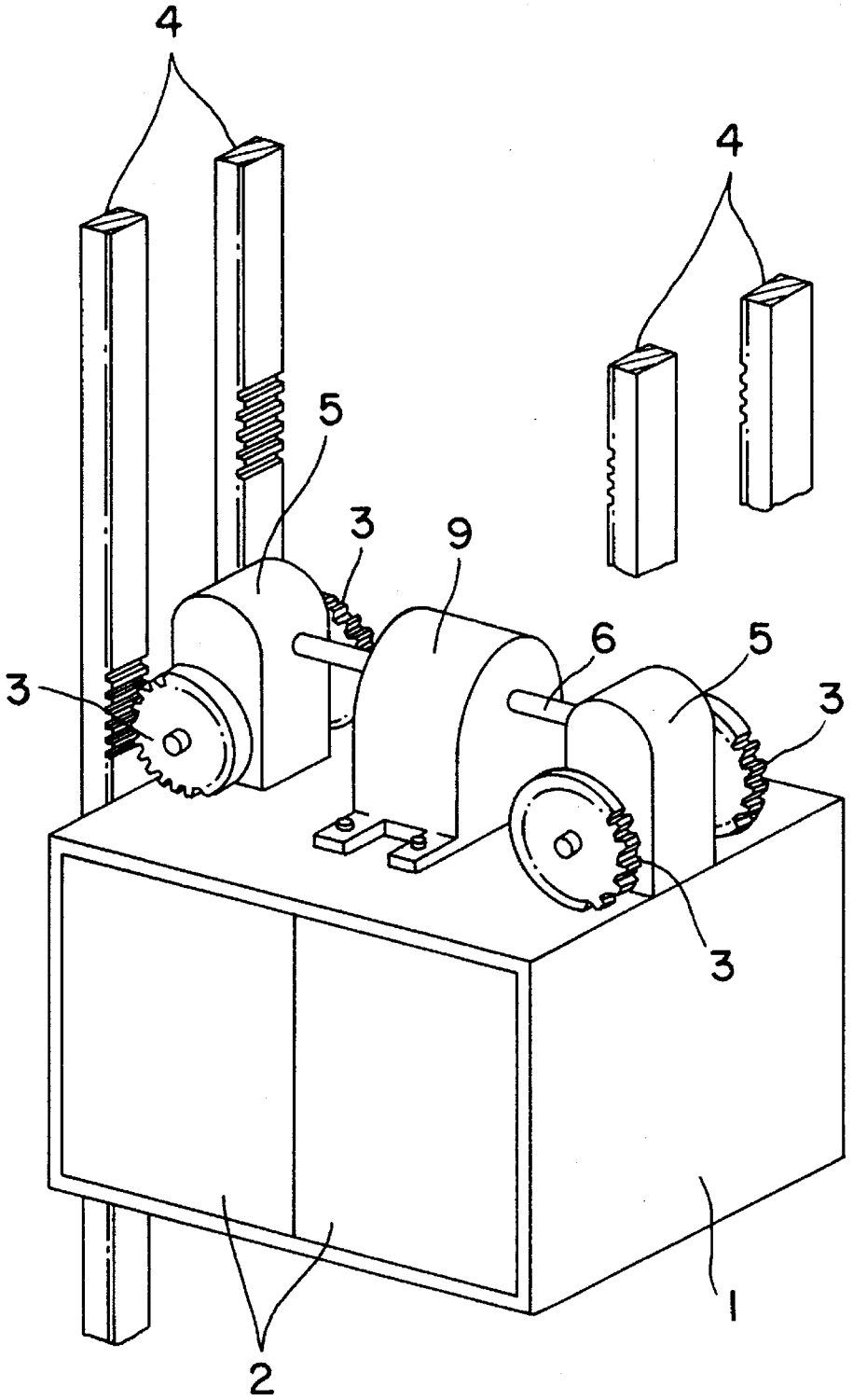
FIG. 1 is a schematic perspective view of an elevator embodying this invention.
Figure 2:
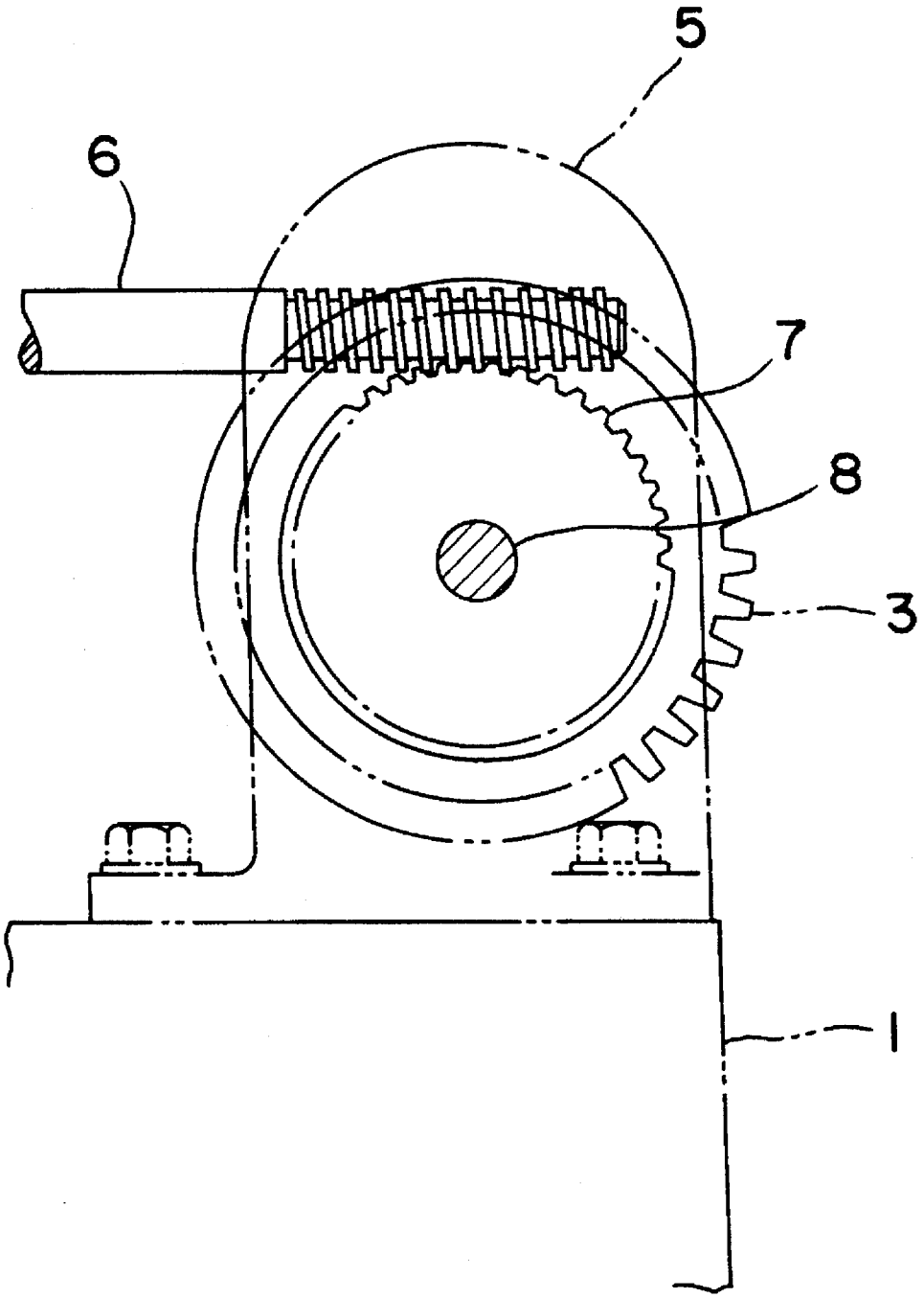
FIG. 2 is an enlarged front elevational view, partly in section, of a part of the elevator shown in FIG. 1.

An elevator embodying this invention is shown in FIGS. 1 and 2. It comprises a cage 1 with a rectangular parallel piped shape having a door 2 in its front surface, two pairs of vertically disposed and horizontally spaced apart pinions 3 provided on the top of the cage 1, two pairs of vertically disposed and horizontally spaced apart racks 4, a pair of gear boxes 5, a pair of screw shafts 6, a pair of crown gears 7, a pair of substantially horizontal shafts 8 each carrying one pair of pinions 3 near the opposite ends thereof, and a motor 9 mounted on the top of the cage 1. Each pair of racks 4 are secured to one of a pair of opposite sidewalls of a vertical elevator passage, or shaft, not shown, which lie at right angles to the door 2. Each shaft 8 extends near and along one of two opposite longitudinal edges of the top of the cage 1 which lie at right angles to the door 2. Each pinion 3 engages one of the racks 4. Each gear box 5 is mounted on the top of the cage 1 adjacent to one of its longitudinal edges, and contains one of the crown gears 7 each secured to one of the shafts 8. The motor 9 is situated between the gear boxes 5. The screw shafts 6 project in opposite directions from the motor 9, and each screw shaft 6 has a threaded end portion meshing with the crown gear 7 in one of the gear boxes 5, as shown in FIG. 2.

If, for example, a passenger riding in the cage 1 depresses a push button, not shown, to go up or down to a particular floor, the motor 9 is rotated in either direction depending on the direction in which the cage 1 is to be moved. If the motor 9 is rotated, the screw shafts 6 are rotated to rotate the crown gears 7, the shafts 8 and thereby the pinions 3, whereby the cage 1 is raised or lowered to convey the passenger to the desired floor.

The screw shafts 6 and the crown gears 7 are irreversible in operation. If the motor 9 is rotated, the screw shafts 6 are rotated to rotate the crown gears 7, as described above. If the rotation of the motor 9 is discontinued, however, the cage 1 stops where it is, and the screw shafts 6 are never rotated by the crown gears 7, however large a load may bear upon the pinions 3 as a result of an earthquake, a change in the total weight of the cage 1 including the passengers, etc. Thus, the screw shafts 6 serve also as a brake system to ensure that the cage 1 be safely held at its stop position.

The pinions 3 and racks 4 provided on both sides of the cage 1 ensure that, even if any pinion 3 or rack 4 may have a broken tooth on one side of the cage 1, the cage 1 be safely movable without having any danger of falling down, if the pinions 3 and the racks 4 on the other side are in proper engagement with each other.

As explained above, as this embodiment does not use hoisting cables which are repeatedly bent and stretched, the advantage which is free from cable break can be realized.

The various devices forming the driving mechanism, except the racks 4, are all installed on the cage 1 itself. The elevator of this invention does not call for any special facilities installed on, for example, the roof of the building. While those devices have been shown as being mounted on the top of the cage 1, it is also possible to install them on the bottom, or underside of the cage 1, or on both the top and bottom thereof.

Although the foregoing description may appear to suggest that the elevator embodying this invention is for passengers, this invention is equally applicable to an elevator for conveying cargo.

What is claimed is:

1. An elevator, comprising:

a vertical elevator passage having sidewalls;

an elevator cage disposed in said vertical elevator passage, said elevator cage comprising a top, a bottom and edges of said top and bottom;

a plurality of vertical racks secured to said sidewalls of said vertical elevator passage;

a plurality of pinions carried on a pair of substantially horizontal rotary shafts that are supported along said edges of one of said top and bottom of said elevator cage and that extend parallel to said sidewalls of said vertical passage having said plurality of vertical racks thereon, said plurality of vertical racks each having at least one of said plurality of pinions engaged therewith; and a means for irreversibly driving said pinions in opposite rotary directions so as to raise and lower said elevator cage along said plurality of vertical racks, said means comprising an irreversible motor mounted on said cage, a plurality of screw shafts that have threaded end portions and that are symmetrically connected to said irreversible motor so as to extend in opposite directions from said irreversible motor, a plurality of crown gears secured to midpoints of said rotary shafts carrying said plurality of pinions, each of said crown gears engaging one of said screw shafts, and a plurality of gear boxes covering said crown gears and said threaded end portions of said screw shafts.

2. The elevator of claim 1, wherein said elevator cage has a door thereon extending perpendicular to said sidewalls having said plurality of vertical racks thereon.

3. The elevator of claim 1, wherein said gear boxes are fixed to said elevator cage along said edges of the one of said top and bottom of said elevator cage.

* * * * *

UNITED STATES PATENT AND TRADEMARK OFFICE

CERTIFICATE OF CORRECTION

PATENT NO. : 5,558,181

DATED : September 24, 1996

INVENTOR(S) : Mutsuro BUNDO

It is certified that error appears in the above-indentified patent and that said Letters Patent is hereby corrected as shown below:

On the title page, item [76], the inventor's address is changed to:

--1238-4, Oaza Miyoshi, Oita-shi, Oita-ken, Japan--.

Signed and Sealed this
Twenty-eighth Day of January, 1997

*Attest:*

Bruce Lehman

BRUCE LEHMAN

*Attesting Officer*

*Commissioner of Patents and Trademarks*